United States Patent [19]

Tarver

[11] Patent Number: 4,955,747

[45] Date of Patent: Sep. 11, 1990

[54] APPLICATOR AND POLISHING DEVICE

[76] Inventor: Matthew A. Tarver, 341 S. Wolf Rd., Des Plaines, Ill. 60016

[21] Appl. No.: 441,280

[22] Filed: Nov. 27, 1989

[51] Int. Cl.[5] ..... A47L 13/30

[52] U.S. Cl. ..... 401/139; 15/145; 15/244.1; 401/137

[58] Field of Search ..... 401/137, 139, 138, 27, 401/37, 123; 15/145, 244.1

[56] References Cited

U.S. PATENT DOCUMENTS

| | | | |
|---|---|---|---|
| 801,087 | 10/1905 | Kahn | 401/202 |
| 2,436,454 | 2/1948 | Sensenbach | 401/139 |
| 2,490,440 | 12/1949 | Jacobs | 15/124 |
| 2,551,220 | 5/1951 | Ploner | 15/124 |
| 2,770,826 | 11/1956 | Curfman | 401/139 |
| 2,828,500 | 4/1958 | Peacock | 15/105 |
| 2,859,463 | 11/1958 | Hirsch | 401/139 |
| 2,886,839 | 5/1959 | Leopoldi | 401/139 |
| 2,886,839 | 5/1959 | 59Leopoldi | 75/126 |
| 3,008,164 | 11/1961 | Herman et al. | 15/160 |
| 3,031,711 | 5/1962 | Herman et al. | 15/528 |
| 3,067,449 | 12/1962 | Weissenbach | 401/18 |
| 3,603,692 | 9/1971 | Ball et al. | 401/139 |
| 3,722,021 | 3/1973 | Brainerd et al. | 15/231 |
| 4,013,369 | 3/1977 | Turek | 401/139 |
| 4,778,301 | 10/1988 | Sicotte | 401/139 |

*Primary Examiner*—Richard J. Johnson
*Attorney, Agent, or Firm*—Olson & Hierl

[57] ABSTRACT

A hand-held device for removably holding a working pad on the lower end of a container that holds a fluid, such as a cleaning compound or a liquid wax, includes attachments for dispensing the fluid and for removably securing the working pad to the container. Gripping features are provided for hand use of the device so that the fluid can be applied to a surface and the surface can be polished by hand using a single device.

32 Claims, 1 Drawing Sheet

APPLICATOR AND POLISHING DEVICE

TECHNICAL FIELD

This invention relates to an improved hand-held applicator and polishing device which is particularly suitable for applying a cleaning compound or wax to automobiles, furniture and the like.

BACKGROUND OF THE INVENTION

The operation of cleaning, waxing and polishing automobiles, motorcycles, furniture, leather goods and the like by hand is usually time-consuming. This process involves a number of steps and the use of working pads for applying a product, spreading the applied product and wiping or polishing the surface onto which the product has been applied.

In particular, the size of an automobile makes cleaning, waxing and polishing by hand both tedious and cumbersome. It is often difficult to achieve a uniform hand rubbed finish. It is also difficult to keep the cleaning and waxing products, along with the various working pads, such as applicating and polishing pads, within easy reach. Consequently, much time can be lost retrieving a desired product or working pad when it is misplaced or out of reach.

To resolve these difficulties, there is a need for a convenient hand-held device for holding a working pad, such as an applicator or polishing pad, and an associated container for holding a cleaning compound or a liquid wax. Such a device must be simple and easy to assemble and operate, as well as convenient and economical to manufacture for repeated use or for disposability

SUMMARY OF THE INVENTION

The present invention relates to an improved hand-held device having certain features for removably holding a working pad, such as an applicator pad, a wiping pad, a polishing pad and the like. Briefly described, the device comprises a container having certain gripping features, means for dispensing fluid contained in the container and means for removably securing the working pad to the container.

Specifically, the device comprises a container for holding a fluid having at least one open upper end, a closed lower end and a gripping portion. The device also includes means for removably securing the working pad about the lower end of the container.

Preferably, the container includes means for supporting the fingers of the user about the gripping portion; and the dispensing means comprises a spray nozzle. The dispensing means can apply the liquid wax or cleaning compound for subsequent spreading and polishing with the working pad.

The securing means for holding the working pad can be removably attached to the lower end of the container by either a friction press-fit or a threadable engagement. Moreover, the working pad element can be either removably mounted or permanently attached to the securing means. Means for adapting the securing means to the lower end of containers of larger or smaller dimensional size or a different configuration of container can be provided to interchangeably secure the working pad to different containers.

These and other features provide a device that is comfortable to hold during operation of the dispensing means and use of the working pad. A device of this invention offers the convenience of allowing the user to hold the device for applying either a liquid, semi-solid or paste product to a surface from the container, spreading the product over the surface and wiping or polishing the surface. A major advantage is that this convenience is provided by a single device. Another benefit is that the device allows the user to achieve a more uniform hand rubbed finish during the polishing operation.

Numerous other features and advantages of the present invention will become apparent from the following detailed description, the accompanying drawings and the appended claims.

BRIEF DESCRIPTION OF THE DRAWINGS

In the drawings, which comprise a portion of the description of the present invention.

DETAILED DESCRIPTION OF PREFERRED EMBODIMENTS

Figure 1:
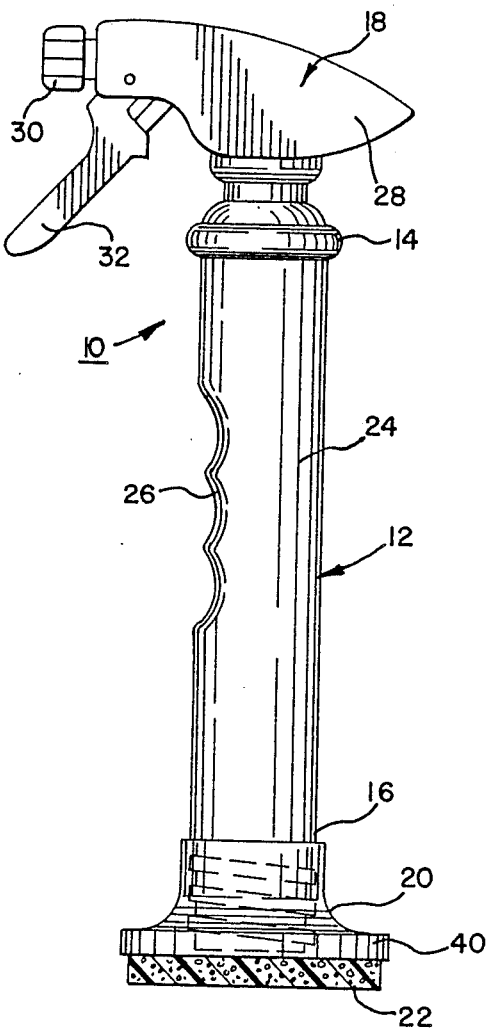
FIG. 1 is a side view of a preferred embodiment of a device of this invention which has been assembled for use.

While this invention is susceptible of embodiment in many forms, there is shown in the drawings and described herein a preferred embodiment and an alternative embodiment of the invention. It should be understood, however, that the present embodiments are to be considered exemplifications of the principles of the invention and are not intended to limit the spirit and scope of the invention or the claims to the embodiments illustrated.

Figure 2:
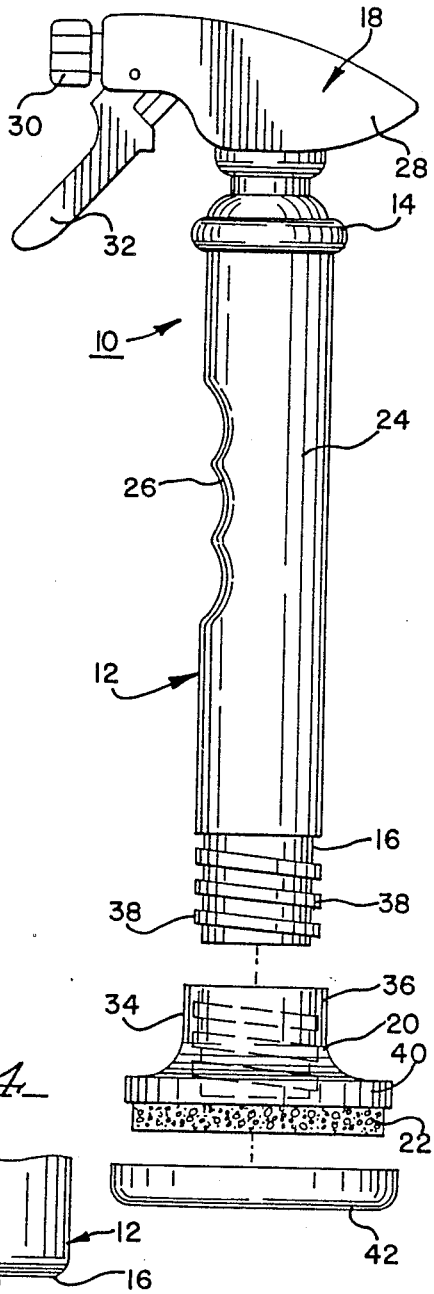
FIG. 2 is a side view of the embodiment of FIG. 1 partially disassembled to show the means for removably securing the working pad to the lower end of the container.

Referring to FIGS. 1 and 2, the device is indicated generally by the reference numeral 10. In FIG. 1, the device is illustrated in an assembled form with all of its preferred features in position for hand-holdable usage. The device 10 comprises a container 12 having an open upper end 14 and a closed lower end 16 for holding a fluid (not shown), means 18 removably secured to the open upper end 14 of the container 12 for dispensing the fluid and means 20 for removably securing a working pad 22 to the closed lower end 16 of the container 12. The device can be comfortably held by a gripping portion 24 of the container 12 when using the dispensing means 18 and the working pad 22.

The device 10 preferably includes finger supporting means 26 disposed thereon defined by the configuration of the gripping portion 24 of the container 12. Alternatively, the finger supporting means 26 can be mounted on the container 12, preferably at or near the gripping portion 24. The finger support means can comprise a handle, strap, band of material or the like to provide for additional gripping leverage and to keep the device 10 from slipping during use.

The height and width of the gripping portion 24 are not limited so long as the device 10 can be hand-held comfortably during the operation of the dispensing means 18 and the working pad 22. In a preferred embodiment, the container can have a gripping portion of about 6–8 inches in height and about 1.5–2.5 inches in diameter.

The dispensing means 18 is removably secured to the open upper end 14 of the container 12, and comprises a manually activated pump preferably comprising a nozzle 30 capable of controllably dispensing the contents of the container as an aerosolized spray or a liquid stream.

As shown in FIGS. 1 and 2, the dispensing means 18 can comprise a finger-activated sprayer including a pump housing 28, nozzle 30 and a finger hold 32. The dispensing means provides a comfortable pisto-type grip and is available commercially and commonly called a "trigger spray". Trigger sprays are typically fitted with a rotatable nozzle for controlling the characteristics of the aerosolized spray, foam or liquid stream dispensed.

The type of dispensing means employed is not limited as long as the fluid can be dispensed. As is known in the art, the dispensing means can be adapted to dispense the fluid in the container as a liquid spray, liquid stream, semi-solid, paste, gel or foam. For example, the container can also hold fluids that are substantially liquid and are maintained within the container under atmospheric or gaseous pressure. These liquid fluids are desirably dispensed in the form of a foam, gel or spray. Alternatively, where the fluid has a semi-solid or paste-like consistency, the fluid is preferably extrudable through the dispensing means. In this latter instance, at least a section of the gripping portion of the container is flexible.

As seen in FIGS. 1 and 2, the dispensing means 18 is threadably attached to the open upper end 14 of the container 12. For this purpose, the upper end 14 of the container 12 includes a threaded portion (not shown) for suitable threadable engagement. Alternatively, the dispensing means can be snapped onto or into the open upper end or otherwise appropriately sealed as by ultrasonic welding, crimping and the like.

The composition of the material that forms the container 12 is not limited and can include glass, metal or plastic or a combination of those materials. Preferably, the container 12 is plastic to provide a device that is lightweight and economical to manufacture, yet sturdy and durable.

The volume capacity of the container is also not limited as long as the device 10 can be comfortably held and used. Typically, if the fluid in the container is a liquid wax product, a volume capacity of about six fluid ounces is preferred. Moreover, the container can include auxiliary openings for introducing additional fluid into the container or for dispensing more than one fluid, as from a compartmented container so long as these features does not interfere with practicing the principles of the device of this invention.

The closed lower end 16 of the container 12 can include an externally defined threaded portion 32 for removably engaging the pad securing means 20 for holding the working pad 22 about the lower end 16 of the container. The device 10 is shown in FIG. 2 with the pad securing means 20 removed. In this embodiment, the pad securing means 20 includes a threaded portion 32 internally defined within a collar portion 36 for releasably engaging threads 38 eternally defined axially about the lower end 16 of the container 12. In this embodiment, the pad securing means 20 can be placed on or removed from the container as desired thereby allowing the user to replace or interchange pad securing means.

Figure 3:
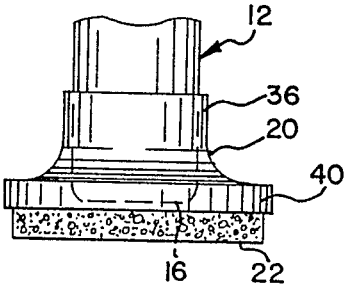
FIG. 3 is a partial side view of a second embodiment of the securing means attached to the lower end of a container.
Figure 4:
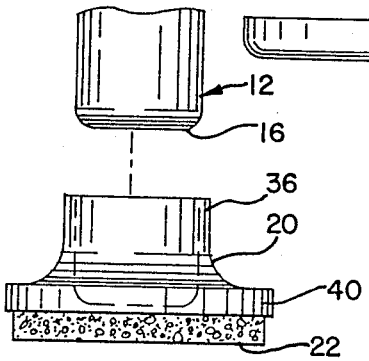
FIG. 4 is a partial side view of the embodiment of FIG. 3 partially disassembled to show the removal of the securing means from the lower end of the container.

An alternative preferred embodiment of the pad securing means is shown in FIGS. 3 and 4. In this embodiment, the pad securing means 20 can be attached about the closed lower end 16 of the container 12 by a friction press-fit. In FIG. 3, the pad securing means 20 is shown snapped into position for use, and in FIG. 4 the pad securing means 20 is shown removed form the lower end 16 of the container 12. In this embodiment, the closed lower end 16 of the container 12 has a generally conventional, substantially flat base.

In the embodiments of the pad securing means 20 shown in FIGS. 1–4, the pad securing means includes the collar portion 36 and a pad-holding surface 40. The diameter of the collar portion 36 is generally dimensioned to attach the pad securing means 20 about the perimeter of the closed lower end 16 of the container 12, and the diameter of the pad-holding surface is generally dimensioned to hold a working pad element 22 having a diameter greater than that of the lower end 16 of the container 12. A protective cover 42 can be removably secured about the padholding surface to protect the pad element during storage (See FIG. 2).

In practice, the dimensional size and shape of the pad securing means 20 preferably is determined by the dimensions and shape of the perimeter of the lower end of the container to enable complementary attachment. Alternatively, the versatility of the device can be extended to include means for adapting (not shown) the pad securing means about the lower end of a container which is larger or smaller in dimensional size or of different configurational shape from the collar portion of the pad securing means. This adapting means can comprise a gasket, a sleeve element, a locking fitting or the like capable of mating the pad securing means with the lower end of the container of the device for service. This feature would extend the versatility of the device without interfering with the removability of the pad securing means for cleaning or replacing of the pad element 22. If desired, the adapting means also can be angled for changing the planar relationship of the pad element to the dispensing means.

As illustrated in FIGS. 1 and 2, the working pad element 22 is located in lineal planar relationship opposite the dispensing means 18. If desired, the planar relationship of the working pad to the dispensing means can be angularly changes by configuring the pad securing means or the lower end of the container or both accordingly to provide the desired angular relationship.

FIGS. 1–4 disclose the working pad element 22 generally held by the pad securing means 20 in substantially integral association therewith. The working pad element 22 can be permanently mounted, as by gluing or preparing the pad element directly on the pad-holding portion of the pad securing means. Alternatively, the pad element 22 can be removably attached to the pad holding portion 40 of the pad securing means 20. For example, the pad element 22 can be configured to slip over, clip onto or snap into pad holding portion of the pad securing means. This feature extends the versatility of the device 10 so that working pads for different purposes can be employed at different stages during the operation of the device; for example, for cleaning, applying wax, spreading the wax, wiping off excess wax and polishing of buffing the cleaned and waxed surface.

The working pad element 22 preferably comprises an absorbent, porous material, such as a sponge or fabric, but is not limited thereto. The pad element can comprise any suitable material for accomplishing the desired cleaning and polishing operation. Preferably, as illustrated in FIGS. 1–4, the working pad element 22 is configured as a generally rounded pad having a diameter and thickness suitable for placing the working pad element 22 in communication with a separate container holding paste wax. This embodiment desirably adapts the working pad element 22 for removing a portion of the paste wax from the container for application. This feature makes the device of this invention particularly useful for waxing automobiles. Moreover, the diameter of the working pad element 22 can be greater than the diameter of the lower end of the container and the diameter of the pad holding portion 40 so that the pad element can be compressed against the surface of the automobile without the pad holding portion contacting and perhaps scratching the surface.

It is recognized that the working pad element of the device of this invention could be permanently secured directly about the lower end of the container. It is believed, however, that this undesirably limits the utility and the versatility of the device. In practice, the diameter of the working pad element would be limited to the diameter of the container. While the lower end of the container could be widened to increase the available size of the pad element, this would be uneconomical and cumbersome.

On the other hand, the principles of the device of this invention allow the user to use a comfortable and holdable container and remove the pad securing means at will. Moreover, the user on remove the pad securing means to clean the working pad element for reuse. Thus, the user has a choice of interchanging reusable or disposable pad elements of various diameters or shapes for different purposes and affects during a hand cleaning and hand polishing operation. In particular, the device of this invention allows a user to wax an automobile using a working pad element of sufficient diameter to uniformly cover a relatively generous size area. The device of this invention allows a person to use a relatively large diameter working pad element of about 3 to about 10 inches, yet comfortably hold the device and achieve uniform leverage while using the device. This feature is a particular benefit for persons having relatively shall hands.

The device of this invention allows the user to achieve more leverage and more uniform contact of the working pad and the surface being polished during hand rubbing and polishing operations. Thus, a more desirably hand-rubbed polishes affect is achieved by practicing the principles of the device of this invention than can be ordinarily achieved conventionally with cloths and like cleaning and waxing implements.

The device can be assembled for use and disassembled easily for storage. When reusable working pad elements are used, a protective cover or holder for these features can be provided for storing the device when it is not in use. For specialty purposes, the device can be made disposable in whole or in part.

Although the present invention has been described with reference to preferred embodiments, various modifications and variations can be made and still provide a device that comes within the scope of this invention. No limitations with respect to the specific embodiments disclosed herein are intended or should be inferred.

What is claimed is:

1. A hand-held device for removably holding a working pad comprising:

(a) a container for holding a fluid having at least one open upper end, a closed lower end and a gripping portion;

(b) means for dispensing the fluid on a surface, the dispensing means being removably secured to the upper end of the container in communication with the fluid in the container; and (c) means for removably securing the working pad about the lower end of the container so that only the working pad contacts the surface when the working pad is compressed against the surface, the lower end of the container including an externally threaded portion adapted to threadably engage the securing means, the securing means including a threaded portion defined thereon, whereby the gripping portion permits the user to hold the container comfortably during operation of the dispensing means or the working pad.

2. The device of claim 1 wherein the container comprises glass, metal or plastic.

3. The device of claim 1 wherein the container further includes means for supporting the fingers of the user.

4. The device of claim 3 wherein the finger supporting means is defined by the configuration of the gripping portion of the container.

5. The device of claim 3 wherein the finger supporting means is mounted on the container.

6. The device of claim 1 wherein the open upper end further includes a threaded portion for removably securing the dispensing means.

7. The device of claim 1 wherein the dispensing means is adapted to dispense the fluid as a liquid spray, liquid stream, semi-solid, paste, gel or foam.

8. The device of claim 1 wherein the fluid is substantially liquid and the dispensing means is a manually activated pump including a nozzle capable of dispensing the contents as an aerosolized spray can as a liquid stream.

9. The device of claim 1 wherein the fluid is maintained within one container under sufficient atmospheric or gaseous pressure to be dispensed as a foam, gel or spray.

10. The device of claim 1 wherein the fluid is extrudable through the dispensing means and at least a section of the gripping portion of the container is flexible.

11. The device of claim 1 wherein the securing means includes a pad element.

12. The device of claim 11 wherein the pad element is an applicator or a polisher.

13. The device of claim 11 wherein the pad element is removably attached to the securing means.

14. The device of claim 11 wherein the pad element comprises an absorbent material.

15. The device of claim 11 wherein the dimensional size and shape of the pad securing means is adapted to communication of the pad element with a separate container holding paste wax for removing a portion of the wax contained therein and applying the wax to a surface with the pad element.

16. The device of claim 1 further including means for adapting the securing means about the lower end of the container when the perimeter of the securing means and the perimeter of the lower end are of unequal size or shape.

17. The device of claim 16 wherein the adapting means comprises a gasket, sleeve element or locking fitting.

18. A handl-held device for polishing a surface comprising:

(a) a container for holding a fluid having at least one open upper end, a closed lower end including an externally threaded portion defined thereon, and a gripping portion;

(b) finger supporting means disposed on the gripping portion of the container;

(c) means for dispensing the fluid remobably secured to the upper end of the container in communication with the fluid in the container; and (d) means for removably securing a generally rounded polishing pad about the lower end of the container, the securing means including a threaded portion defined therein to threadably enage the threaded portion of the lowr end, the diamer of the polishing pad being greater than the diameter of the lower end of the container and the diameter of the securing means whereby the container can be comfortably held during operation of the dispensing means and use of the polishing pad.

19. The device of claim 18 wherein the polishing pad can be compressed against the surface without the securing means contacting the surface.

20. A device for removably securing a working pad to a hald-held device including a container for holding a fluid, the container having an open upper end, a closed lower end, a gripping portion and means for dispensing the fluid removably secured to the open upper end, the lower end of the container including an externally threaded portion axially defined thereon, the device comprising a collar portion and a pad-holding portion, the collar portion including an internally threaded portion adapted to threadably engage the lower end of the container for removably mounting the securing means to the lower end of the container and a pad-holding portion adapted for holding a working pad, whereby the container can be hand-held during operation of the dispensing means or use of the working pad.

21. The device of claim 20 further including means for adapting the securing means about the lower end of the container, when the container is unequal in size or shape from the collar portion for the securing means.

22. The securing means of claim 20 including a pad element.

23. A hand-held device for removably holding a working pad comprising:

(a) a container for holding a fluid having at least one open upper end, a closed lower end and a gripping portion;

(b) means for dispensing the fluid on a surface, the dispensing means being removably secured to the upper end of the container in communication with the fluid in the container; and (c) means for removably securing the working pad about the perimeter of the lower end of the container, the securing means including a collar portion and a pad-holding surface, the collar portion generally dimensioned to attach the securing means to the lower end by as friction press fit so that only the working pad contacts the surface when the working pad is compressed against the surface, whereby the gripping portion permits the user to hold the container comfortably during operation of the dispensing means or the working pad.

24. The device of claim 23 wherein the securing means includes a pad element and the pad element is an applicator or a polisher.

25. The device of claim 24 wherein the pad element is removably attached to the securing means.

26. The device of claim 24 wherein the dimensional size and shape of the pad securing means is adapted for communication of the pad element with a separate container holding paste wax for removing a portion of the wax contained therein and applying the wax to a surface with the pad element.

27. The device of cliam 24 further including means for adapting the securing means about the lowr end when the perimeter of the securing means and the perimeter of the lower end are of unequal size or shape.

28. The device of claim 27 wherein the adapting means comprises a gasket, sleeve element or locking fiting.

29. The device of claim 24 wherein the pad element is a generally rounded polishing pad, the polishing pad being greater than the diameter of the lower end of the container and the diameter of the securing means whereby the container can be comfortably held during operation of the dispensing means and use of the polishing pad.

30. A device for removably securing a working pad to a hand-held device including a container for holding a fluid, the container having an open upper end, a closed lower end, a gripping portion and means for dispensing the fluid removably secured to the open upper end, the lower end of the container including means for securing the working pad o the container comprising a collar portion and a pad-holding portion, the collar portion adapted for removably mounting the securing means about the perimeter of the lower end of the container by a friction press fit and the pad-holding portion adapted for holding a working pad, whereby the container can be hand-held during operation of the dispensing means or use of the working pad.

31. The device of claim 31 further including means for adapting the securing means about the lower end of the ontainer, when the containe is unequal in size or shape from the collar portion for the securing means.

32. The securing means of claim 30 including a pad element.

* * * * *

UNITED STATES PATENT AND TRADEMARK OFFICE

CERTIFICATE OF CORRECTION

PATENT NO. : 4,955,747

DATED : September 11, 1990

INVENTOR(S) : Matthew A. Tarver

It is certified that error appears in the above-identified patent and that said Letters Patent is hereby corrected as shown below:

Column 1, line 34, after "disposability", insert --.--.

Column 3, line 55, change "does" to --do--.

Column 4, line 66, change "of" to --or--.

Column 5, line 30, change "and holdable" to --hand-holdable--;

Column 5, line 41, change "generous size" to --generous-size--;

Column 5, line 47, change "shall" to --small--;

Column 5, line 52, change "polishes" to --polished--.

Column 6:

Claim 1, line 17, change "thereon" to --therein--.

UNITED STATES PATENT AND TRADEMARK OFFICE

CERTIFICATE OF CORRECTION

PATENT NO. : 4,955,747

DATED : September 11, 1990

INVENTOR(S) : Matthew A. Tarver

It is certified that error appears in the above-identified patent and that said Letters Patent is hereby corrected as shown below:

Column 6:

Claim 8, line 41, change "can" to --or--.

Claim 9, line 44, change "one" to --the--.

Column 7:

Claim 18, line 4, change "handl-held" to --hand-held--;

Claim 18, line 18, change "enage" to --engage--;

Claim 18, line 19, change "lowr" to --lower--;

Claim 18, line 19, change "diamer" to --diameter--.

Claim 20, line 30, change "hald-held" to --hand-held--.

Column 8:

Claim 23, line 6, change "as" to --a--.

UNITED STATES PATENT AND TRADEMARK OFFICE

CERTIFICATE OF CORRECTION

PATENT NO. : 4,955,747

DATED : September 11, 1990

INVENTOR(S) : Matthew A. Tarver

It is certified that error appears in the above-identified patent and that said Letters Patent is hereby corrected as shown below:

Column 8, line 24, claim 27, line 1, change "cliam"to --claim--.

Claim 27, line 25, change "lowr" to --lower--.

Claim 28, line 30, change "fiting" to --fitting--.

Claim 30, line 44, change "o" to --to--.

Claim 31, line 52, change "31" to --30--;

Claim 31, line 54, change "ontainer" to --container--;

Claim 31, line 54, change "containe" to --container--.

Signed and Sealed this

Twelfth Day of May, 1992

*Attest:*

DOUGLAS B. COMER

*Attesting Officer*

*Acting Commissioner of Patents and Trademarks*